US008182008B2

(12) United States Patent
Meckwood

(10) Patent No.: US 8,182,008 B2
(45) Date of Patent: May 22, 2012

(54) CARRYING APPARATUS

(75) Inventor: Kimberly Meckwood, Los Angeles, CA (US)

(73) Assignee: Click & Carry, Inc., Los Angeles, CA (US)

( * ) Notice: Subject to any disclaimer, the term of this patent is extended or adjusted under 35 U.S.C. 154(b) by 0 days.

(21) Appl. No.: 12/986,041

(22) Filed: Jan. 6, 2011

(65) Prior Publication Data

US 2011/0095553 A1 Apr. 28, 2011

Related U.S. Application Data

(63) Continuation-in-part of application No. 12/057,188, filed on Mar. 27, 2008, now Pat. No. 7,874,602.

(51) Int. Cl.
*A45F 5/00* (2006.01)

(52) U.S. Cl. ..... 294/137; 294/158

(58) Field of Classification Search ..... 294/137, 294/158, 145, 171, 146, 159
See application file for complete search history.

(56) References Cited

U.S. PATENT DOCUMENTS

| | | | | |
|---|---|---|---|---|
| 2,676,836 | A * | 4/1954 | Raphael | 294/87.24 |
| 6,694,574 | B1 * | 2/2004 | Sheng | 294/82.11 |
| 7,125,061 | B1 * | 10/2006 | Hajianpour | 294/159 |
| 2008/0276430 | A1 * | 11/2008 | Sharpe | 294/137 |
| 2009/0206621 | A1 * | 8/2009 | Payne | 294/158 |

* cited by examiner

*Primary Examiner* — Paul T Chin
(74) *Attorney, Agent, or Firm* — F. Jason Far-hadian, Esq.; Century IP Group

(57) ABSTRACT

A carrying apparatus comprising: an upper portion having at least one terminal end cantileverly extending from a first point in the upper portion; a lower portion comprising at least one terminal end having a receiving area formed on a first side of the lower portion on which at least a looped handle of a carrying item may rest, wherein at least one terminal end of the upper portion engages in an interlocking operational relationship with at least one terminal end of the lower portion.

20 Claims, 9 Drawing Sheets swivel open & loop bags in

Carrying Apparatus

Carrying Apparatus side view top view

Carrying Apparatus: PARTS

Carrying Apparatus: USE swivel open & loop bags in swivel closed and carry side view

Carrying Apparatus: USE

CARRYING APPARATUS

CROSS-REFERENCE TO RELATED APPLICATIONS

This Application claims priority to and is a continuation-in-part of patent application Ser. No. 12/057,188 filed on Mar. 27, 2008 and issued as patent No. U.S. Pat. No. 7,874,602 on Jan. 25, 2011, the content of which is incorporated herein by reference, in entirety.

TECHNICAL FIELD

The present disclosure relates generally to carrying apparatuses and more particularly to a carrying apparatus designed for use in connection with looped handles, to provide for convenient and comfortable transportation of multiple items such as shopping bags, umbrellas, handbags, etc. The apparatus may also include advertising space, such that it may be given away as a promotional item by a supermarket or other business.

BACKGROUND

The transport of multiple shopping bags is generally difficult, especially over long distances. Shopping bags can be heavy and cumbersome to carry. For example, the bags can bump into one another and into the person carrying them, causing injury or discomfort.

To avoid this difficulty and discomfort, individuals are often forced to make multiple trips when transporting shopping bags from place to place, such as from one's car to one's home. By making multiple trips, the individual can avoid the discomfort of transporting multiple shopping bags by hand, but only after expending considerable time and effort.

A person might also be unable to carry as many shopping bags as they would like if they are traveling long distances, such as from the store to their home via public transportation. Fatigue or pain also typically result from carrying a heavy load over a long distance, using the standard looped handles of the shopping bags.

It would be advantageous if one could easily carry multiple shopping bags or other items without having to endure the above-noted discomfort.

SUMMARY

In accordance with one embodiment, a carrying apparatus is provided. The apparatus comprises an upper portion having at least one terminal end cantileverly extending from a first point in the upper portion; a lower portion comprising at least one terminal end having a receiving area formed on a first side of the lower portion, facing the upper portion, on which at least a looped handle of a carrying item may rest and a handling area formed on a second side of the lower portion opposite the first side forming a grip to lift the apparatus.

A connection mechanism may be provided for connecting the upper portion and the lower portion, wherein the connection mechanism allows the upper portion to swivel in relation to the lower portion, such that in an open position the looped handle may be placed on the receiving area, and in a closed position the upper portion swivels to cover the terminal end of the lower portion and the receiving area in a closed loop to secure the looped handle, eliminating possibility of the looped handle sliding off the receiving area and the terminal end of the lower portion.

The grip area may be monolithic with respect to the lower portion and located below the connection mechanism that allows the upper portion to swivel in relation to the lower portion. The at least one terminal end of the upper portion engages in an interlocking operational relationship with the at least one terminal end of the lower portion when in the closed position such that any downwardly force exerted on the receiving area of the lower portion as the result of the weight of a carrying item is directly transferred to the terminal end of the upper portion.

In one implementation, the interlocking operational relationship results in the terminal end of the upper portion to react by pulling upwardly on the terminal end of the lower portion engaged thereto, increasing an interlocking force between the two terminal ends of the upper portion and the lower portion in proportion to the downwardly force applied to the receiving area as the result of the weight of the carrying items.

In one embodiment, the receiving area of the lower portion is divided into sub-receiving areas by one or more dividing mechanisms to allow the weight of one or more carrying items to be staggered across the receiving area. The grip area may comprise a malleable substance that helps ease pressure on a body part of a person used for holding the apparatus.

BRIEF DESCRIPTION OF THE DRAWINGS

The disclosed embodiments may be better understood by referring to the figures in the attached drawings, as provided below.

Features, elements, and aspects that are referenced by the same numerals in different figures represent the same, equivalent, or similar features, elements, or aspects, in accordance with one or more embodiments.

Any sizes or measurements shown in the figures are exemplary in nature and may include approximations. The measurements are applicable to one or more embodiments and are provided by way of example and as such should not be construed as limiting the scope of the claims. It is noteworthy that in certain embodiments, sizes or measurements other than that shown in the figures may be applied without detracting from the scope of the presently claimed subject matter.

DETAILED DESCRIPTION OF EXAMPLE EMBODIMENTS

In the following, numerous specific details are set forth to provide a thorough description of various embodiments. Certain embodiments may be practiced without these specific details or with some variations in detail. In some instances, certain features are described in less detail so as not to obscure other aspects. The level of detail associated with each of the elements or features should not be construed to qualify the novelty or importance of one feature over the others.

Figure 1:
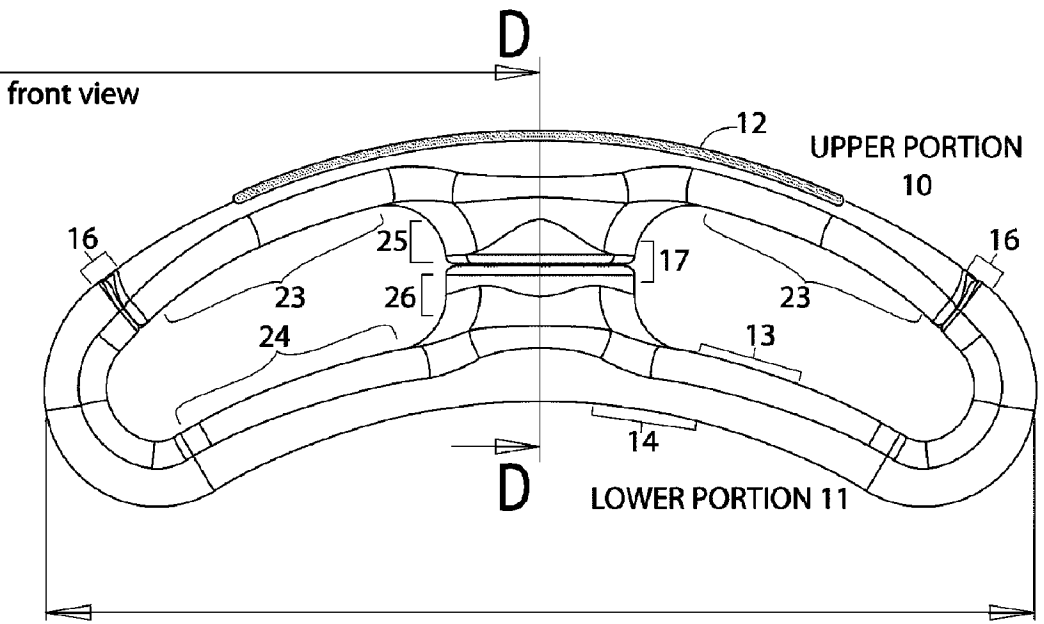
FIG. 1 is a front view of a carrying apparatus, in accordance with one embodiment.
Figure 2:
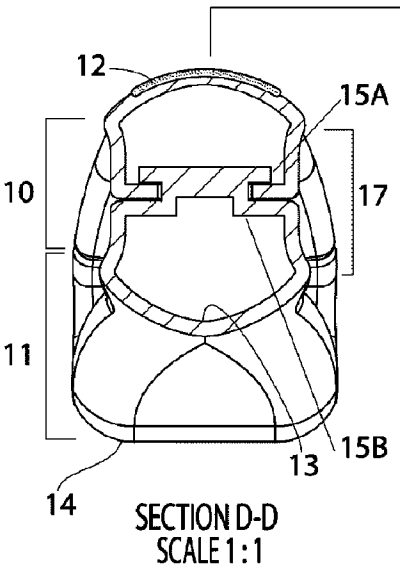
FIG. 2 is a cross-sectional view of the carrying apparatus taken at cross-section D-D of FIG. 1.
Figure 3:
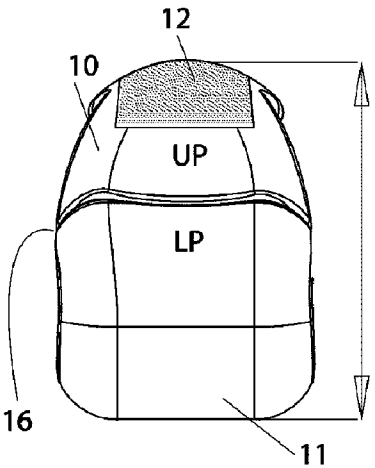
FIG. 3 is a side view of the carrying apparatus of FIG. 1.
Figure 4:
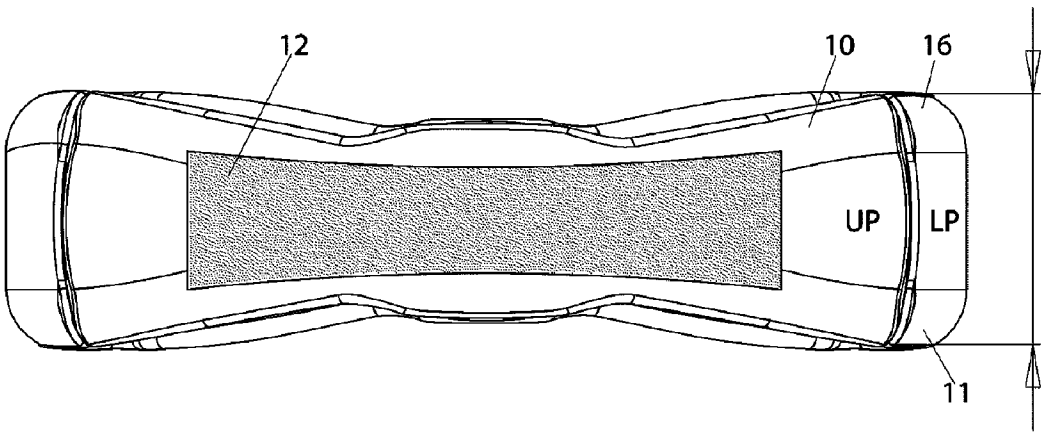
FIG. 4 is a top view of the carrying apparatus of FIG. 1.

A carrying apparatus for convenient and comfortable transportation of multiple shopping bags or other items is illustrated in FIG. 1. In one embodiment, the carrying apparatus comprises an upper portion 10, and a lower portion 11. The lower portion may comprise at least one terminal end having a receiving area 13 formed on a first side of the lower portion 11, facing the upper portion 10. At least a looped handle 20 of a bag or carrying item may rest on the upper portion 10 (see FIGS. 7 through 9).

A handling area 14 may be formed on a second side of the lower portion 11 opposite the first side forming a grip, for example, for a person to lift the apparatus. A connection mechanism 17 allows the upper portion 10 to connect to and swivel in relation to the lower portion 11, such that in an open position a looped handle 20 may be placed on the receiving area 13 (see FIG. 7, for example).

In a closed position, the upper portion 10 swivels to cover the terminal end of the lower portion 11 and the receiving area 13 in a closed loop to secure the looped handle 20. The closed loop construction eliminates the possibility of the looped handle 20 sliding off the receiving area 13 and the terminal end of the lower portion 11. In one embodiment, the upper portion 10 comprises an upper neck 25 and two arms 23. Optionally, the arms 23 cantiliverly extend outward from the center of the upper portion 10 where upper neck 25 is positioned. Each of the arms 23 comprises a proximate end near the upper neck 25 and a distal end furthest from the upper neck 25. In the exemplary embodiment illustrated in FIG. 1, optionally, the arms 23 gently slope toward the lower portion 11 as they extend away from the upper neck 25 of the apparatus.

The lower portion 11 comprises a lower neck 26 and two arms 24. In one embodiment, the arms 24 may slope away from the upper portion 10 and then curve in a sharp angle preferably in the opposite direction toward the upper portion 10. The arms 24 are curved in a manner such that the arms 23 and the arms 24 touch at distal connection points 16, collectively forming two closed loops, one loop on each side of upper neck 25 and lower neck 26.

Figure 5:
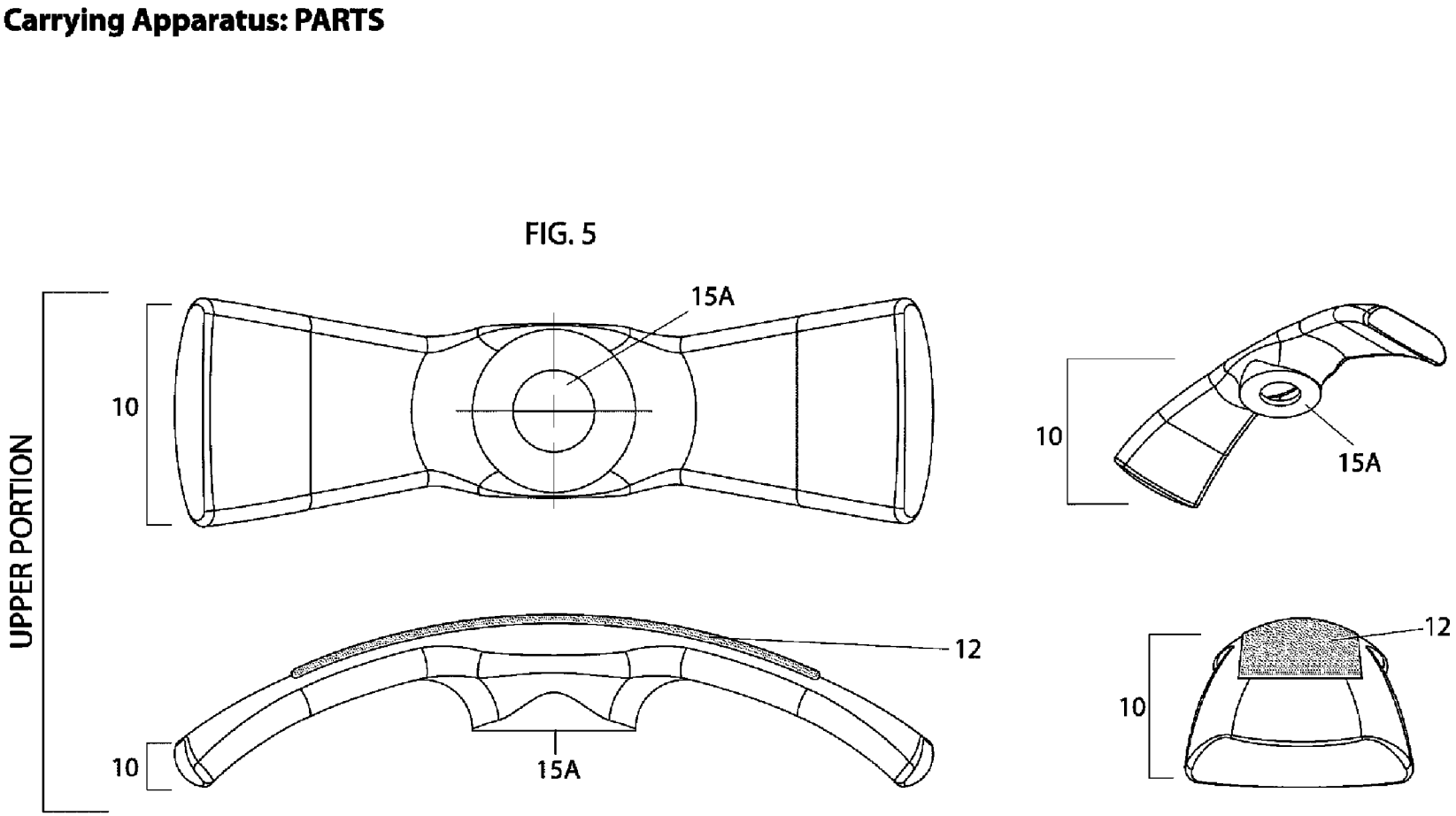
FIG. 5 is an exploded view of the upper portion of the carrying apparatus from multiple angles, in accordance with one embodiment.
Figure 6:
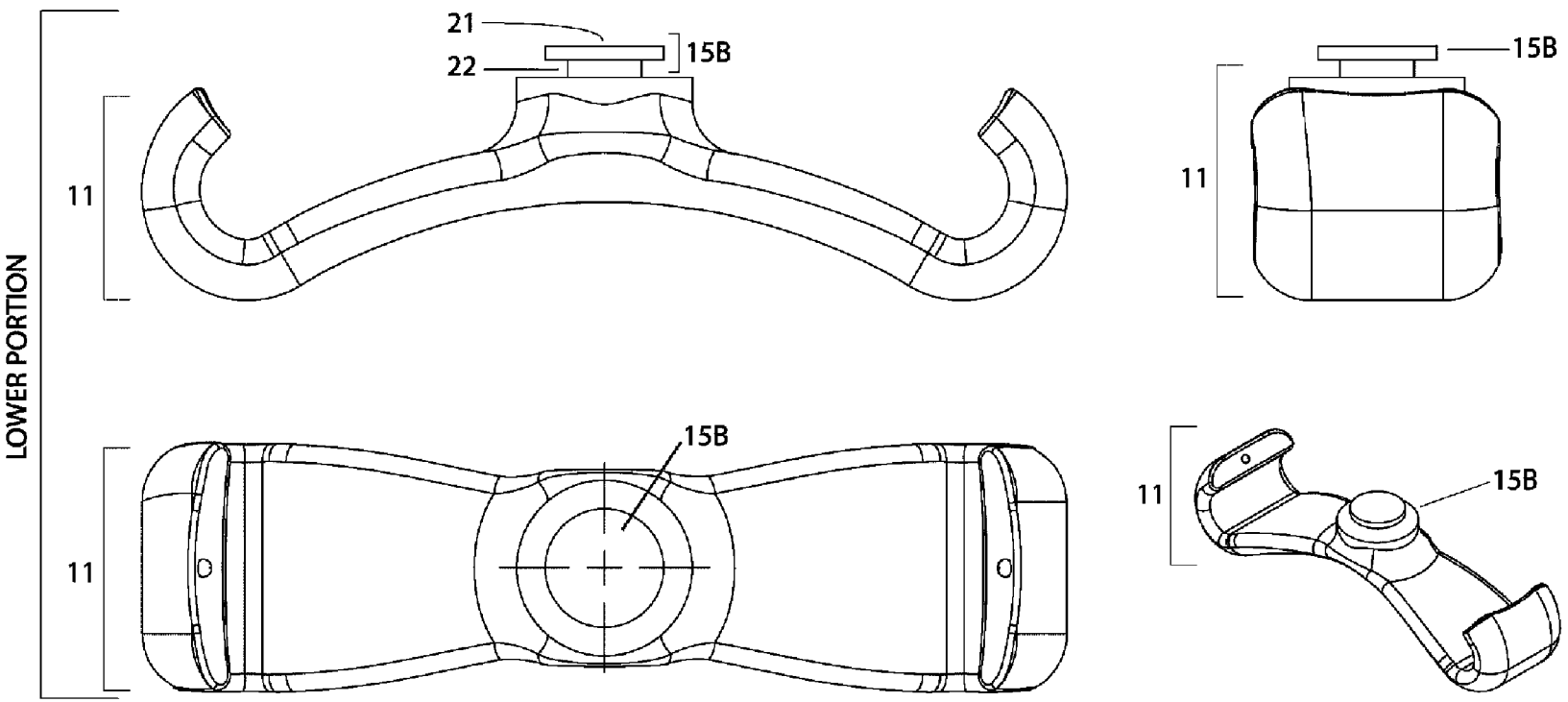
FIG. 6 is an exploded view of the lower portion of the carrying apparatus from multiple angles, in accordance with one embodiment.

As noted, the lower portion has a receiving area 13 and a handling area 14, and the upper portion 10 and the lower portion 11 are connected via a connection mechanism 17 which spans the distal ends of both the upper neck 25 and the lower neck 26 as shown in FIGS. 1 through 11. Referring to FIGS. 5 and 6, in one embodiment, the connection mechanism 17 may comprise a snap-fit construction with a receiving cavity 15A on the upper neck 25 and a complementary protruding area 15B on the lower neck 26 that allows the upper portion 10 to rotate over the lower portion 11, as provided in further detail below. In certain embodiments, instead of a snap-fit construction, a magnetic assembly may be utilized to construct the connection mechanism 17, with oppositely charged magnates fixed to upper neck 25 and lower neck 26 each.

Figure 7:
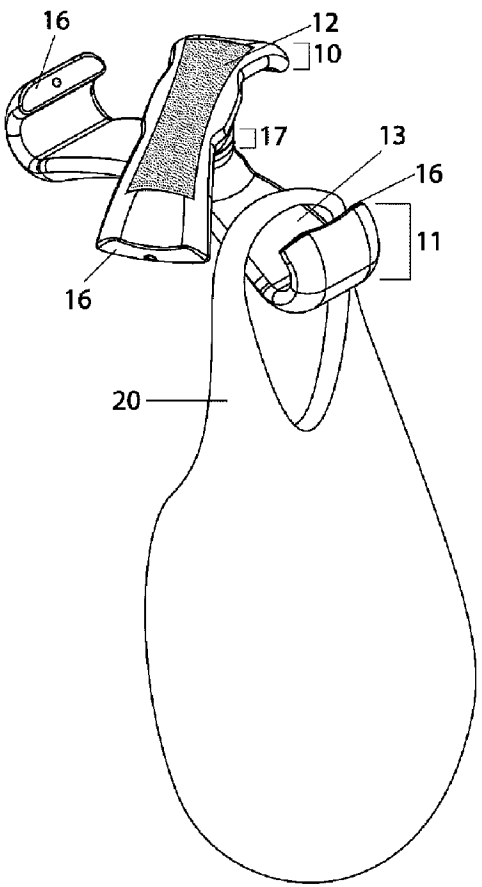
FIG. 7 is a view of the carrying apparatus in an open position, with a shopping bag engaging the lower portion, in accordance with one embodiment.

To use the carrying apparatus, a user may swivel the carrying apparatus to an open position. In one embodiment, swiveling of the apparatus to an open position involves rotating the upper portion 10 in relation to the lower portion 11 about a swivel axis of connection mechanism 17, as is illustrated in FIG. 7. Note that in this embodiment, when the apparatus is in an open position, the arms 23 and 24 are not touching at the outer connection points 16, as the upper neck 25 and the lower neck 26 remain connected via the connection mechanism 17. The user may then place the desired looped handles 20 of one or more carrying items onto the receiving area 13 of the lower portion 11.

Figure 8:
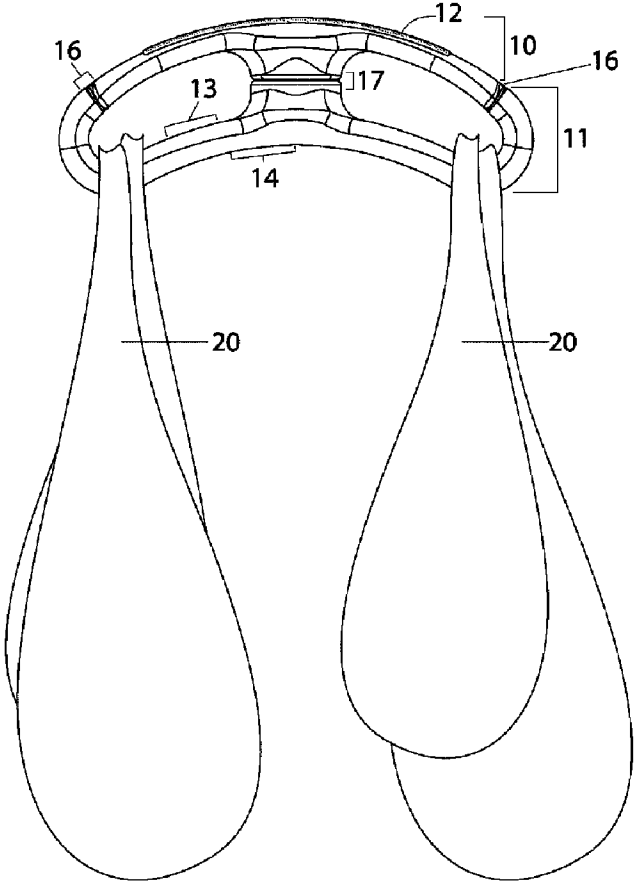
FIG. 8 is a front view of the carrying apparatus in a closed position, with several shopping bags engaging multiple hook positions, in accordance with one embodiment.
Figure 9:
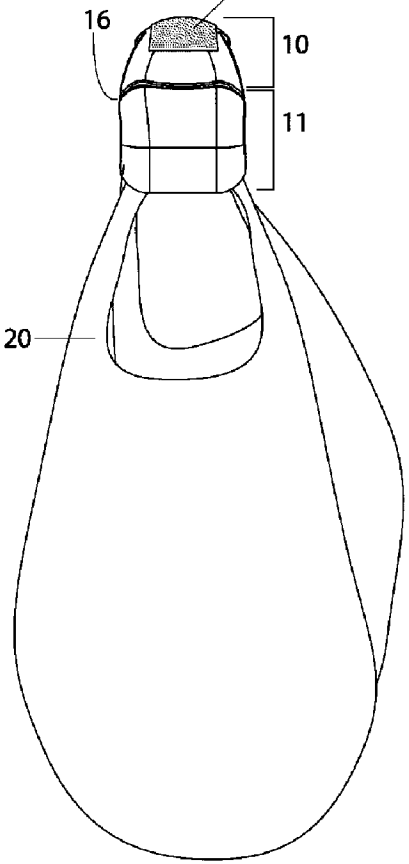
FIG. 9 is a side view of the carrying apparatus in a closed position, in accordance with one embodiment.

After placing the desired looped handles 20 onto the receiving area 13, the user may then swivel the carrying apparatus to a closed position to prevent the looped handles 20 from sliding off the receiving area 13. In one embodiment, swiveling the apparatus to a closed position involves rotating the upper portion 10 in relation to the lower portion 11 about a swivel axis of connection mechanism 17, as illustrated in FIGS. 8 and 9. Note that in this embodiment, when the apparatus is in a closed position, the arms 23 and 24 are touching at the distal connection points 16, while the upper neck 25 and the lower neck 26 are connected via the connection mechanism 17.

Depending on implementation, upper portion 10 and lower portion 11 may rotate about the central swivel axis of connection mechanism 17, for example from 0 to 360 degrees, either freely or in a step-lock fashion, due to designer grooves (not shown) optionally carved into the surface portions of the upper neck 25 and lower neck 26 that face each other, to provide an adjustable means for controlling the level by which the apparatus is maintained in an open position. As such, the user of the carrying apparatus may have the option to vary the opening angle for the carrying apparatus as is convenient or necessary to insert or remove the looped handles 20 of one or more carrying items.

The snap-fit construction in accordance with one embodiment is shown in greater detail in FIGS. 5 and 6. The receiving cavity 15A of the upper neck 25 is illustrated in FIG. 5. The complementary protruding area 15B of the lower neck 26 is illustrated in FIG. 6. In the illustrated embodiment, the protruding area 15B (i.e., the male portion) will snap and fit into a receiving cavity 15A (i.e., the female portion), such that the upper portion 10 and the lower portion 11 will be connected via the connection mechanism 17, while still allowing rotational movement between the upper portion 10 and the lower portion 11.

The snap-fit construction of the male and female portions are such that the male portion comprises a relatively elongated protruding area 15B having an end 22 proximate to the inner area of the lower neck 26 and a terminal end 21 that extends away from said proximate end 22. The width or diameter of the terminal end 21 about its elongated axis is sufficiently larger than that of the proximate end 22 and than that of the internal diameter of receiving cavity 15A, such that when the terminal end 21 engages the female portion in a snap-fit manner, the terminal end 21 of the male portion may not be easily removed from the receiving cavity 15A of the female portion.

In an alternative embodiment, the snap-fit construction is implemented so that the male portion may be removably attached to the female portion. That is, the width or diameter of the terminal end 21 about its elongated axis may be slightly larger than the internal diameter of the receiving cavity 15A to allow a user to insert or remove the male portion in or from the female portion without exertion of a substantial amount of force. In this manner, a user may also choose to carry the lower portion 11 independent of the companion upper portion 10. The lower portion 11 may be used in the same manner as disclosed above. Without the upper portion 10, however, a user may not be able to secure the looped handles 20 by placing the carrying apparatus in a closed position. Regardless, the lower portion 11 by itself does have utility for allowing a user to carry multiple items at the same time.

Figure 10:
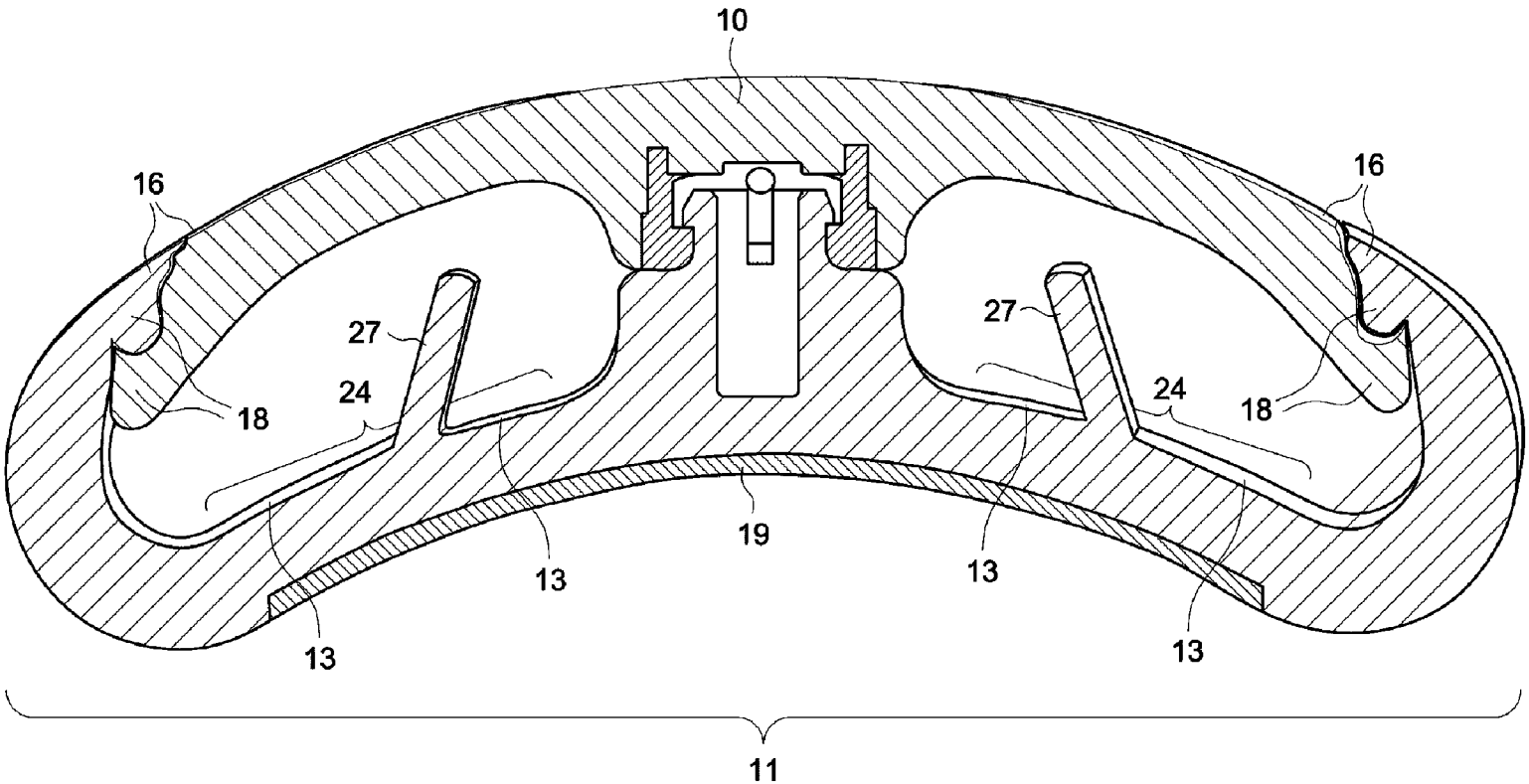
FIG. 10 is a frontal view of the carrying apparatus, in accordance with another embodiment.

In accordance with another aspect, a comfortable grip on the handling area 14 may be provided for easing pressure on the hand or figures of a person using the apparatus. In one embodiment, the handling area 14 of the lower portion 11 comprises a gel-grip or other ergonomic design (e.g., gripping grooves, etc.) for comfortable handling. Depending on implementation, a malleable substance may be applied or positioned on the handling area 14 or over the entire bottom surface of the lower portion 11 for easing pressure on the hand, fingers, or any other part of a person using the apparatus. Referring to FIG. 10, in one example embodiment, the malleable substance may comprise a conforming gel 19, a sponge grip or other type of supple substance that would provide a similar feel, either structurally or functionally.

In certain embodiments, the handling area 14 is of a substantial width to allow distribution of pressure across a greater area of the user's hand and to reduce level of pressure on the user's grip. Distribution of the pressure alleviates the associated discomfort that can result from carrying heavy items that have thin carrying handles that cut or dig into a person's flesh. Further, a relatively wider grip area may be designed in certain embodiments to allow a person to place the handling area 14 over his shoulder, for example, thereby providing a hands-free mode of use depending on user preference or particular circumstance or handicap.

In accordance with one embodiment, the outer connection points 16 (i.e., the distal ends of the arms 23 and 24 of respectively lower portion 11 and upper portion 10) are designed to be in an operational relationship with each other in a way to increase the carrying capacity of the carrying apparatus by providing an interlocking mechanism to securely hold the outer connection points 16 of arm 23 to those of the arm 24. As shown in exemplary FIGS. 10 and 11, in one embodiment, hook-shaped lips 18 may be formed on one or more of the outer connection points 16 such that if the arm 24 on the lower portion 11 is bent as the result of the applied pressure from the weight of the bags hanging therefrom, the arm 23 on the upper portion 10 is also bent as a result of the interlocking engagement between the outer connection points 16.

The above disclosed interlocking arrangement, advantageously, increases the stability of the carrying apparatus to withstand greater downward exertion of pressure from the weight of the bags being carried, and also helps maintain the carrying apparatus in a closed position when the lips 18 are engaged. In example embodiments that do not include the above interlocking feature, excessive downward force applied to the lower portion 11 may cause the outer connection points 16 of the upper and the lower portions 10 and 11 to not fit tangentially, thereby creating a gaping space through which the looped handles 20 may escape.

Figure 11:
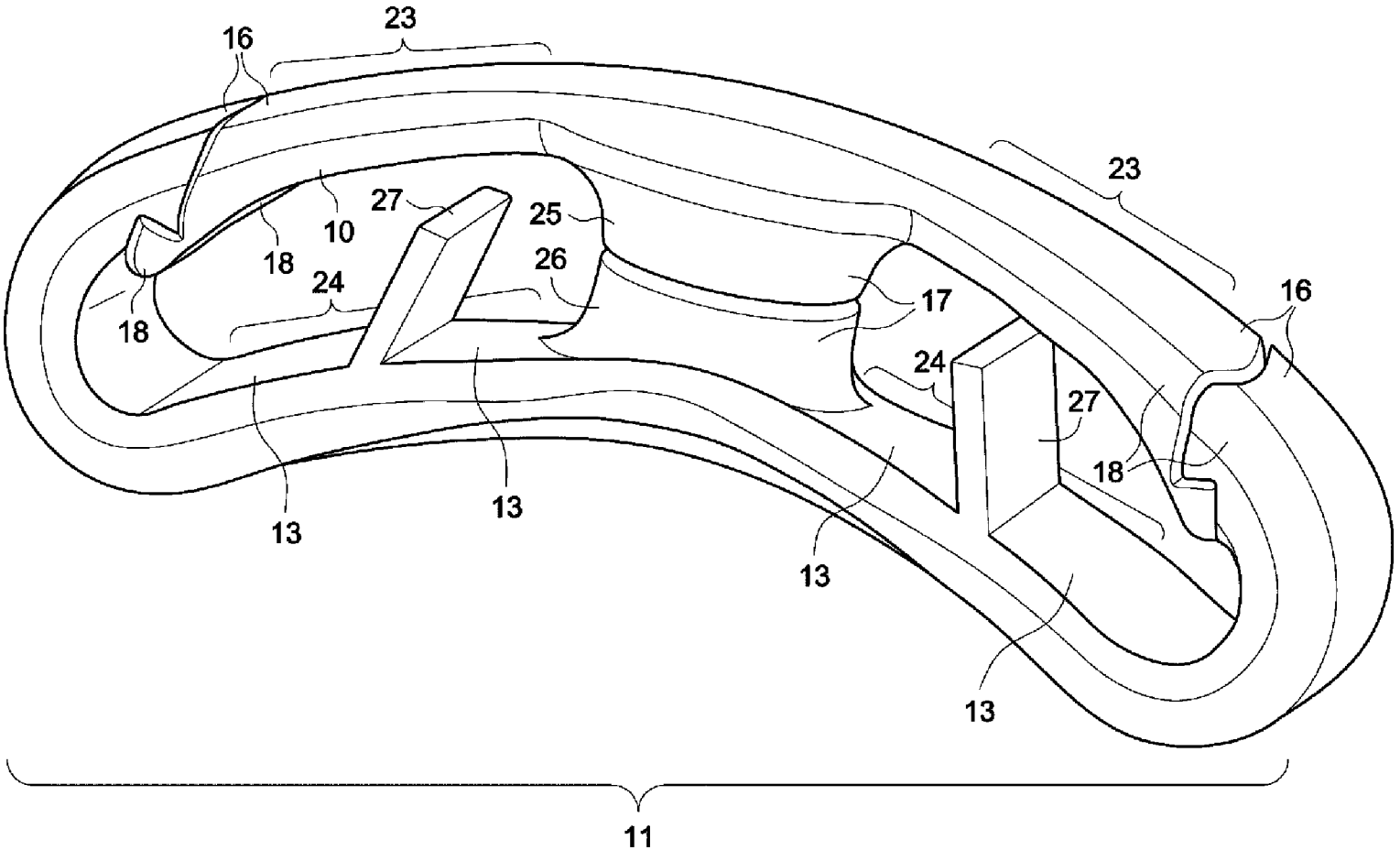
FIG. 11 is a frontal perspective view of the carrying apparatus of FIG. 10 in a closed position.
Figure 12:
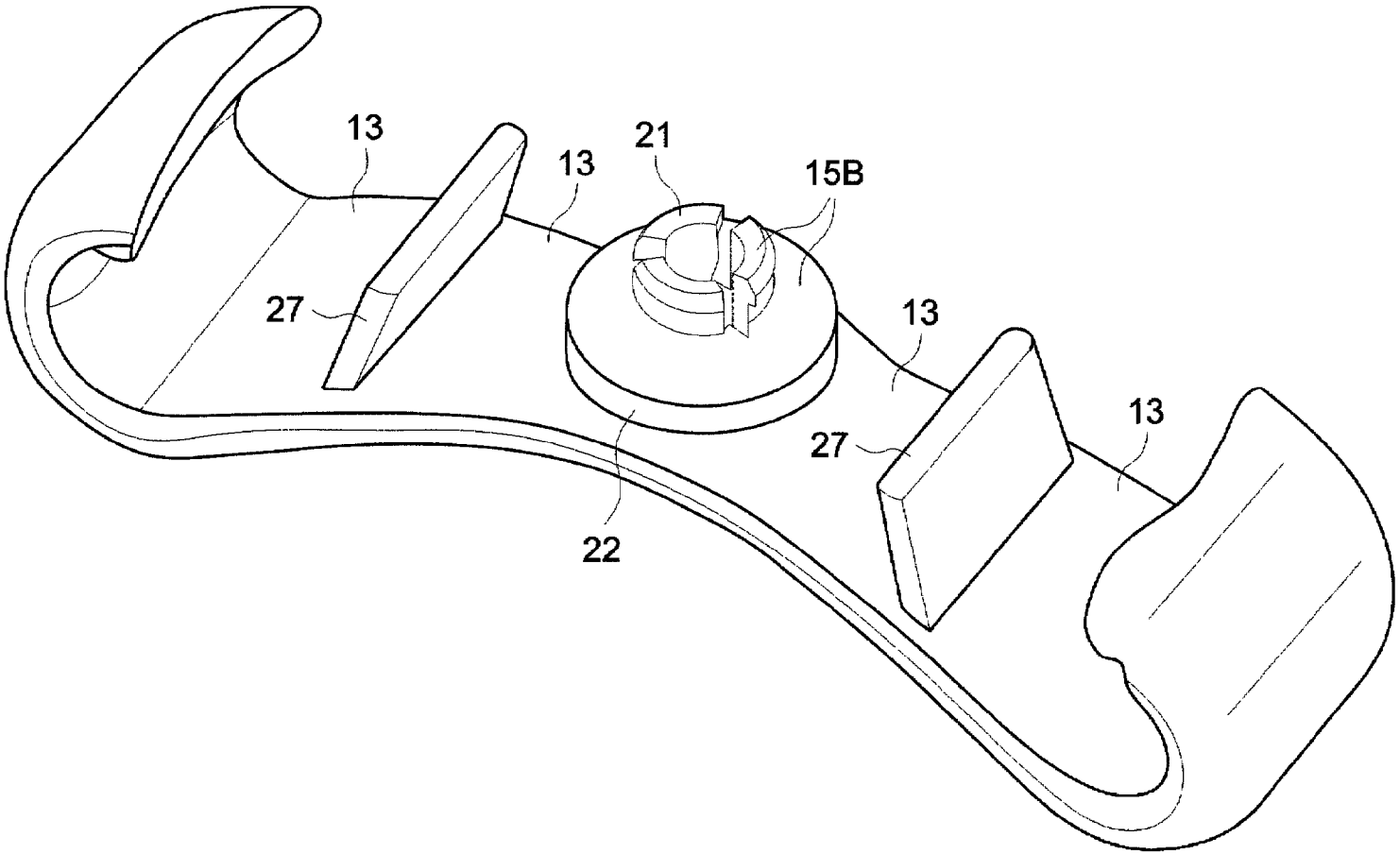
FIG. 12 is a frontal perspective view of the lower portion of the carrying apparatus in accordance with one embodiment.

Referring to FIGS. 10 through 12, in accordance with yet another aspect, a tiered design is implemented, wherein the receiving area 13 is divided into multiple sub-receiving areas by way of one or more dividing structures. As shown, the dividing structure may comprise one or more dividers 27. A divider 27 may be configured in form of an elongated shaft-like plate (e.g., in the form of a finger, a hook, a dull skewer or blade or other component having a similar shape or function) protruding out of the receiving area 13.

The divider 27 may be optionally slanted towards the lower neck 26 to allow for the looped handle 20 of a shopping bag to be securely hooked against the divider 27, preventing the looped handle 20 from sliding down all the way toward the lowest point of the lower portion 11 (e.g., near the area that curves upward). In other words, particularly in embodiments where the lower portion 11 is sloped downwards, the inclusion of the dividing structures helps a user to stagger the looped handles of shopping bags along the length of the lower portion 11 such that the weight of the items being carried is more evenly spread, contributing to a more balanced carrying experience and additional longevity of the carrying apparatus itself by way of avoiding pressure built-up at the lowest points of the lower portion 11.

In one example, on each side of the carrying apparatus, one set of looped handles 20 may be placed on the receiving area 13 between the divider 27 and the connection mechanism 17, another set may be placed on the divider 27 itself, and a third set may be placed on the receiving area 13 between the divider 27 and the lowest point of the lower portion 11. In this particular example, the apparatus may carry 3 sets of shopping bags per side of the apparatus, for a total of 6 sets of items at a time.

Depending on implementation, more or less dividing mechanisms may be included along the length of the lower portions 11. In some embodiments, some of the dividing structures may be designed in the form of a cavity (e.g., a ridge, a dimple, a dip, a crevice, etc.) carved or formed onto the receiving area 13 accommodating sub-receiving areas in which the looped handle of a shopping bag may be caught. The depth and shape of such cavity is designed so that the looped handle is securely positioned in said cavity once caught, wherein the looped handle is limited in movement and does not continually pop in or out of the cavity, thus, providing for a better carrying experience for a user.

An optional feature of the apparatus is to have it function as a promotional item for supermarkets or other businesses. In one embodiment, for example, the apparatus has a panel 12 on which an advertisement may be placed (See FIGS. 4 and 5 in particular). The panel 12 may be located on the upper portion 10 or other position on the apparatus that has high visibility to a user or others.

Desirably, the upper portion 10 and lower portion 11 are constructed of a molded plastic, optionally comprising an inner metal reinforcement, in accordance to one or more embodiments. The inner metal reinforcement may be in the form of a metal mesh or in the form of a single or a network of metal wires running through or embedded in a molded plastic body.

Depending on implementation and in alternative embodiments, the apparatus and its various components may be made from any material suitable for carrying out the functions and purposes disclosed above. Not all components need to be made from the same material, but never-the-less for the purpose of efficiency and cost control, the upper and lower portions 10 and 11 may each have a monolithic construction.

Some embodiments may be constructed from natural material such as wood, rubber, or various types of metals, or alternatively from artificially produced material such as epoxy resin, solidified plastic or other artificial byproducts of petroleum, or a combination of said material.

The claimed subject matter has been provided here with reference to one or more features or embodiments. Those skilled in the art will recognize and appreciate that, despite of the detailed nature of the exemplary embodiments provided here, changes and modifications may be applied to said embodiments without limiting or departing from the generally intended scope. These and various other adaptations and combinations of the embodiments provided here are within the scope of the disclosed subject matter as defined by the claims and their full set of equivalents.

What is claimed is:

1. An apparatus comprising:

an upper portion having at least one terminal end cantileverly extending from a first point in the upper portion;

a lower portion comprising at least one terminal end having a receiving area formed on a first side of the lower portion, facing the upper portion, on which at least a looped handle of a carrying item may rest and a handling area formed on a second side of the lower portion opposite the first side forming a grip to lift the apparatus; and a connection mechanism for connecting the upper portion and the lower portion, wherein the connection mechanism allows the upper portion to swivel in relation to the lower portion, such that in an open position the looped handle may be placed on the receiving area, and in a closed position the upper portion swivels to cover the terminal end of the lower portion and the receiving area in a closed loop to secure the looped handle, eliminating possibility of the looped handle sliding off the receiving area and the terminal end of the lower portion, wherein the grip area is monolithic with respect to the lower portion and located below the connection mechanism that allows the upper portion to swivel in relation to the lower portion, and wherein the at least one terminal end of the upper portion engages in an interlocking operational relationship with the at least one terminal end of the lower portion when in the closed position such that any downwardly force exerted on the receiving area of the lower portion as the result of the weight of a carrying item is directly transferred to the terminal end of the upper portion, wherein the interlocking operational relationship results in the terminal end of the upper portion react by pulling upwardly on the terminal end of the lower portion engaged thereto, increasing an interlocking force between the two terminal ends of the upper portion and the lower portion in proportion to the downwardly force applied to the receiving area as the result of the weight of the carrying items.

2. The apparatus of claim 1, wherein the receiving area of the lower portion is divided into sub-receiving areas by one or more dividing mechanisms to allow the weight of one or more carrying items to be staggered across the receiving area.

3. The apparatus of claim 1, wherein the grip area comprises a malleable substance that helps ease pressure on a body part of a person used for holding the apparatus.

4. The apparatus of claim 1, wherein the upper portion and lower portion are constructed of a molded plastic.

5. The apparatus of claim 1, wherein the upper portion and lower portion are constructed of a molded plastic comprising an inner metal reinforcement.

6. The apparatus of claim 1, wherein the handling area comprises of a gel-grip for comfortable handling.

7. The apparatus of claim 1, wherein height to width ratio of the handling area is conducive to distribution of pressure across a relatively wide grip area to reduce pressure on the grip.

8. The apparatus of claim 1, wherein the upper portion has an external side and an internal side facing the receiving area of the lower portion, wherein the upper portion is bent in a bow shape, such that the concave side of the upper portion faces the receiving area of the lower portion, and wherein the lower portion is bent in a bow shape, such that the convex side of the lower portion faces the concave side of the upper portion.

9. The apparatus of claim 8, wherein the upper portion is connected to the lower portion by way of at least the connection mechanism such that the connection mechanism connects center of the upper portion to center of the lower portion and wherein the upper portion and the lower portion are shaped such that width of the center cross sections of the upper portion and the lower portion is smaller than width of the terminal ends of the lower portion and the upper portion such that the upper portion and the lower portion are partially tapered inwardly toward their centers.

10. The apparatus of claim 9, wherein the upper portion and the lower portion, each have two opposing terminal ends, wherein locations where the terminal ends of the upper portion meet the terminal ends of the lower portion are formed to have male and female locking dimples, such that when the male and female locking dimples are aligned additional friction created between the male and female locking dimples prevents the upper portion to easily unlock from the lower portion.

11. An apparatus comprising, an upper portion;

a lower portion comprising at least one terminal end having a receiving area formed on a first side of the lower portion, facing the upper portion, on which at least a looped handle of one or more shopping bags may rest and a handling area formed on a second side of the lower portion opposite the first side forming a grip to lift the apparatus, wherein the handling area forming said grip has a substantially wide surface area to spread respective weight of said one or more shopping bags across fingers of a user lifting the one or more shopping bags engaged in the receiving area of the lower portion; and a connection mechanism for connecting the upper portion and the lower portion, wherein the connection mechanism allows the upper portion to swivel in relation to the lower portion, such that in an open position the looped handle may be placed on the receiving area, and in a closed position the upper portion swivels to cover the terminal end of the lower portion and the receiving area in a closed loop to secure the looped handle of the one or more shopping bags, eliminating possibility of the looped handle of the one or more shopping bags sliding off the receiving area and the terminal end of the lower portion, wherein the grip area is monolithic with respect to the lower portion and located below the connection mechanism that allows the upper portion to swivel in relation to the lower portion.

12. The apparatus of claim 11, wherein the connection mechanism has a snap-fit construction, for allowing the top portion to rotatably connect to the lower portion about a central axis.

13. The apparatus of claim 11, wherein the connection mechanism utilizes a multi-magnet construction, for allowing the upper portion to detachably connect to the lower portion.

14. The apparatus of claim 11, wherein the upper portion and lower portion are constructed of a molded plastic.

15. The apparatus of claim 11, wherein the upper portion and lower portion are constructed of a molded plastic comprising an inner metal reinforcement.

16. The apparatus of claim 11, wherein the handling area comprises of a gel-grip for comfortable handling.

17. The apparatus of claim 11, wherein the handling area is of a substantial width to distribute pressure across a greater area and reduce pressure on the grip.

18. The apparatus of claim 11, wherein the upper portion has an external side and an internal side facing the receiving area of the lower portion, wherein the upper portion is bent in a bow shape, such that the concave side of the upper portion faces the receiving area of the lower portion, and wherein the lower portion is bent in a bow shape, such that the convex side of the lower portion faces the concave side of the upper portion.

19. The apparatus of claim 18, wherein the upper portion is connected to the lower portion by way of the connection mechanism such that the connection mechanism connects center of the upper portion to center of the lower portion and wherein the upper portion and the lower portion are shaped such that width of the center cross sections of the upper portion and the lower portion is smaller than width of the terminal ends of the lower portion and the upper portion such that the upper portion and the lower portion are partially tapered inwardly toward their centers.

20. The apparatus of claim 19, wherein the upper portion and the lower portion, each have two opposing terminal ends, wherein locations where the terminal ends of the upper portion meet the terminal ends of the lower portion are formed to have male and female locking dimples, such that when the male and female locking dimples are aligned additional friction created between the male and female locking dimples prevents the upper portion to easily unlock from the lower portion.

* * * * *